US005338205A

United States Patent [19]

Kusano

[11] Patent Number: 5,338,205

[45] Date of Patent: Aug. 16, 1994

[54] POOL FOR PRACTICING AND ENJOYING WATER-SKIING

[76] Inventor: Hideo Kusano, 3-11-19, Kamo, Kawanishi-shi, Hyogo-ken, Japan, 666

[21] Appl. No.: 76,853

[22] Filed: Jun. 15, 1993

[51] Int. Cl.[5] ..... A63B 69/18; B63B 1/00; A63D 15/12

[52] U.S. Cl. ..... 434/253; 482/71; 441/69

[58] Field of Search ..... 434/253, 254; 482/71; 441/68, 69

[56] References Cited

U.S. PATENT DOCUMENTS

| | | | |
|---|---|---|---|
| 2,815,951 | 12/1957 | Baldanza | 434/253 |
| 3,523,307 | 8/1970 | Buswell | 434/253 |
| 3,598,402 | 8/1971 | Frenzl | 434/253 X |

FOREIGN PATENT DOCUMENTS

| | | | |
|---|---|---|---|
| 2837391 | 3/1980 | Fed. Rep. of Germany | 441/69 |
| 3930452 | 3/1991 | Fed. Rep. of Germany | 482/71 |
| 49-38540 | 10/1974 | Japan . | |
| 0799772 | 1/1981 | U.S.S.R. | 482/71 |

OTHER PUBLICATIONS

"Water Skiing Without Boats", Popular Mechanics, Jun. 1979, p. 90.

*Primary Examiner*—Gene Mancene
*Assistant Examiner*—Cindy A. Cherichetti
*Attorney, Agent, or Firm*—Wenderoth, Lind & Ponack

[57] ABSTRACT

A pool for simulating water-skiing includes a pool body, a pumping plant which pumps water into the pool body as a stream just under the surface of the water in the pool body, a track supported above the periphery of the pool body, an automatic traveling member engaged with the track and capable of automatically traveling along the track, and a tow rope having one end attached to the traveling member. To practice standing up on water skis at the beginning of water-skiing, the traveling member is made to move along the track thereby pulling the skier from a remote position, for example, to a position in the stream of water injected into the pool. If kept at this position the skier can practice skiing with little difficulty. To simulate slaloming, the automatic traveling member can be controlled to travel back and forth along the track so that the skier's position relative to the stream of injected water is varied.

4 Claims, 2 Drawing Sheets

POOL FOR PRACTICING AND ENJOYING WATER-SKIING

BACKGROUND OF THE INVENTION

The present invention relates to a pool for practicing and enjoying water-skiing.

A prior art pool for practicing water-skiing is disclosed in Japanese Patent Publication No. 49-38540.

This prior art pool includes a device for making a fast stream beneath stationary water-skis so that water-skiing in which a skier skis on still water or gently flowing water as pulled by a motor boat at a high speed can be simulated.

The device comprises a tank and a pumping plant. The pumping plant draws out liquid from a part of the tank and delivers the liquid through holes to form an upward stream flowing against the liquid surface and also delivers the liquid to nozzles to form a horizontal stream flowing along the liquid surface. In an actual practice, when a skier grasps one end of a rope of which the other end is fixed to a part of the tank and keeps his or her skis on the flowing liquid, the skier is maintained stationary on the surface of the flowing liquid, which looks as if the skier is actually water-skiing.

However, in the above device, the skier cannot practice standing up to begin water-skiing because one end of the rope is fixed to the tank and the skier is kept in nearly one position. Further, the skier cannot enjoy slaloming.

SUMMARY OF THE INVENTION

An object of the present invention is to provide a pool for practicing and enjoying water-skiing in which an end of a tow rope is connected to an automatic traveling member the movement of which is controllable so that the skier can practice slaloming and standing up on his or her skis.

In order to achieve the above object, a pool for practicing and enjoying water-skiing according to the present invention comprises a pool body and a pumping plant. Water is sucked from the pool body or supplied from other water sources and is injected out horizontally along the water surface to form a stream beneath the water surface. The water is injected out as a stream having a predetermined width and a predetermined speed. A track extends above the periphery of the pool body at a predetermined height and is engaged with an automatic traveling member. The automatic traveling member is provided with a tow rope the free end of which is formed as a handle. The movement and speed of the automatic traveling member is controllable.

During use the automatic traveling member travels to a position above a water injecting port so that a skier can practice standing up prior to water-skiing. Further, when the automatic traveling member stops at the position above the water injecting port, the skier can enjoy skiing in which there is little variety in the skier's position and normal skiing in a stationary position. Furthermore, when the automatic traveling member travels leftward and rightward, the skier can enjoy slaloming in which the towing direction against the stream varies.

DETAILED DESCRIPTION OF THE PREFERRED EMBODIMENT

Figure 1:
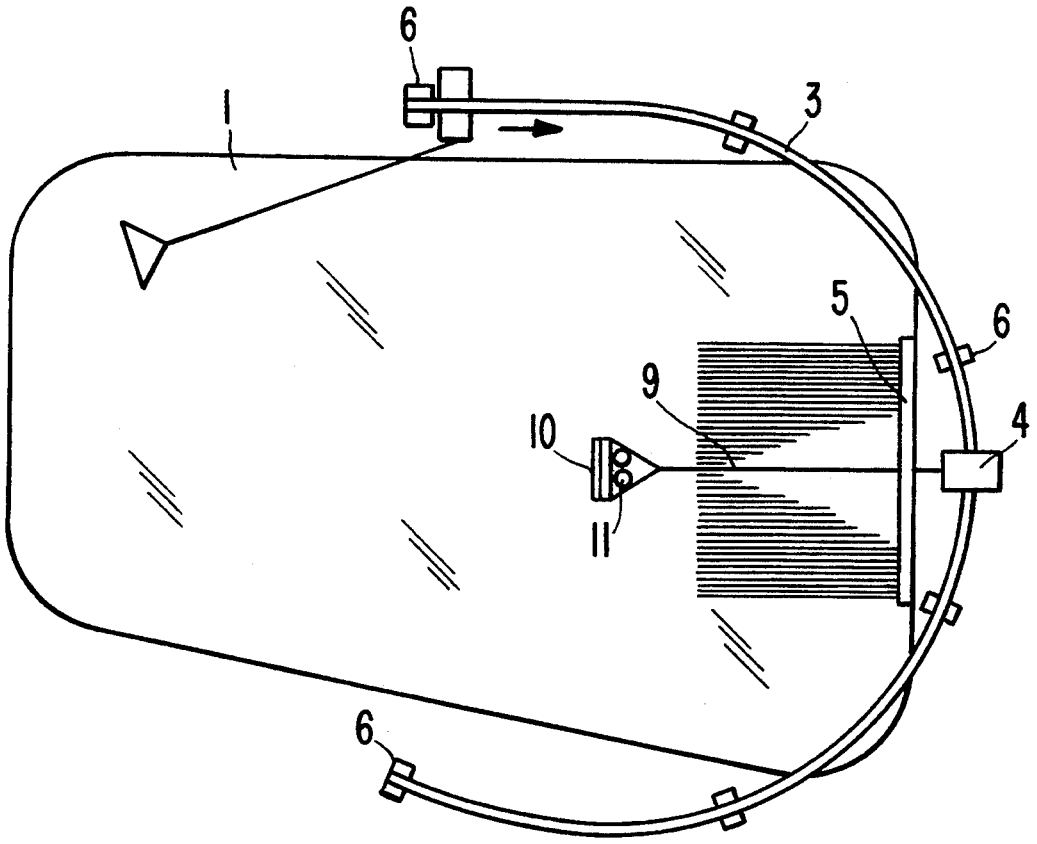
FIG. 1 is a schematic plan view of a pool for practicing and enjoying water-skiing according to the present invention.
Figure 2:
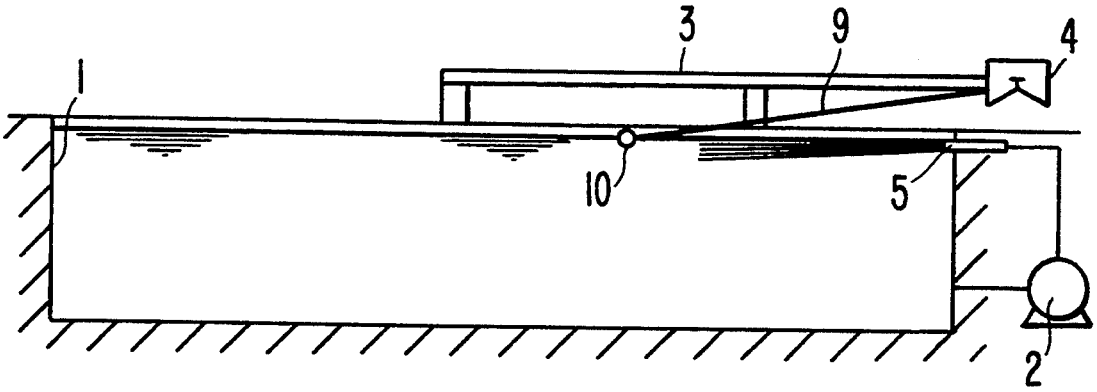
FIG. 2 is a schematic cross-sectional view of the pool for practicing and enjoying water-skiing according to the present invention.
Figure 3:
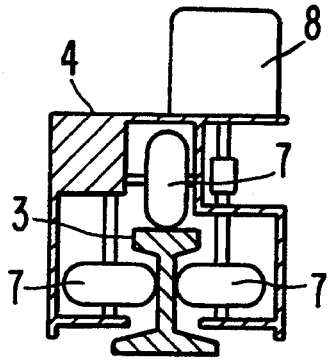
FIG. 3 is a schematic cross-sectional view of an automatic traveling member engaged with a track.

A preferred embodiment of the present invention will now be described referring to the accompanying drawings.

A pool for practicing and enjoying water-skiing according to the present invention comprises a pool body 1, a pumping plant 2, a track 3 and an automatic traveling member 4.

The pumping plant 2 is connected to the pool body 1 via a pipe line so that water is sucked from the pool 1 and is delivered to an injection port 5 from which the water is injected out horizontally as a stream having a predetermined width. The pumping plant 2 can preferably control the speed at which the water is injected by changing the speed gradually or with some steps under a previously established program. The injection port 5 is in the form of a rectangular nozzle having a parallel slit or a parallel nozzle defining injection holes.

A track 3 is a monorail having an I-shaped cross section and extending above periphery of the pool body 1. The track 3 is supported on posts 6 of about 1–1.5 m in length which are spaced along periphery of the pool body 1 at predetermined intervals. The track 3 may be formed by two rails or by a wire rope having a circular cross section. Any substitutes for the track 3 are acceptable so long as the track can guide the automatic traveling member 4 which will be described in the following paragraphs.

The automatic traveling member 4 includes rolling elements 7 arranged at an upper portion and at both sides of the track 3. A driving force of a reciprocally rotatable motor 8 is transmitted to the rolling elements 7. An end of a tow rope 9 is fixed to the automatic traveling member 4 at a side thereof nearest to the pool body 1. Wiring to control the reciprocally rotatable motor 8 (not shown in the drawings) is provided inside of the tow rope 9 and control buttons 11 are arranged on a handle 10 at the free end of the tow rope 9. The reciprocally rotatable motor 8 may be controlled by a previously established program instead of being controlled by the skier.

The following is a preferable way of using the above-described pool for practicing and enjoying water-skiing. In the first place, the automatic traveling member 4 is placed at either end of the track 3, for example, at the upper end in the FIG. 1, which the tow rope 9 is left free in the pool body 1.

A skier wearing a set of skis grasps the handle 10 at the end of the tow rope 9. The skier operates a control button 11 which causes the automatic traveling member to travel to the right to a position just above the injection port 5. Therefore, the skier enters the stream so as to be able to practice standing up at the beginning of water-skiing, skiing in which there is little variety in the skier's position and normal skiing in a stationary position. Further, when the control buttons 11 on the handle 10 are operated so that the automatic traveling member 4 travels leftward and rightward, the skier can enjoy slaloming in which the towing direction against the stream varies.

I claim:

1. A pool for practicing and enjoying water-skiing, comprising:

a pool body to accommodate a body of water in which water-skiing is to be simulated;

a pumping plant which pumps water, and a port open to the interior of the pool body at an upper portion of the pool body, said pumping plant being connected to the port so as to supply water as a stream into the pool through said port, the stream flowing horizontally adjacent the surface of a body of water when the pool body is filled with water to a level above the location at which the port opens to the interior of the pool body;

a track supported above the pool body and extending along the periphery of the pool body including at a location above and adjacent to said port;

an automatic traveling member engaging said track and guided thereby, said automatic traveling member including a main body and a controllable motor so coupled to said main body as to drive the main body along said track; and a tow rope having one end attached to said automatic traveling member and a free end including a handle.

2. A pool for practicing and enjoying water-skiing as claimed in claim 1, and further comprising at least one control button integrated with said handle, said control button being operatively connected to said controllable motor such that the output of said motor can be controlled by a skier via said control button.

3. A pool for practicing and enjoying water-skiing as claimed in claim 2, wherein said controllable motor is a variable speed motor.

4. A pool for practicing and enjoying water-skiing as claimed in claim 1, wherein said controllable motor is a variable speed motor.

* * * * *